US008262436B2

(12) United States Patent
De Gobbi

(10) Patent No.: US 8,262,436 B2
(45) Date of Patent: Sep. 11, 2012

(54) STONE WALL GRINDING AND POLISHING SYSTEM

(75) Inventor: Alberto De Gobbi, Suffield, CT (US)

(73) Assignee: Permasteelisa North America, Windsor, CT (US)

( * ) Notice: Subject to any disclaimer, the term of this patent is extended or adjusted under 35 U.S.C. 154(b) by 343 days.

(21) Appl. No.: 12/687,983

(22) Filed: Jan. 15, 2010

(65) Prior Publication Data

US 2010/0178849 A1 Jul. 15, 2010

Related U.S. Application Data

(60) Provisional application No. 61/144,766, filed on Jan. 15, 2009.

(51) Int. Cl.
*B24B 1/00* (2006.01)

(52) U.S. Cl. ..... 451/41; 451/354; 451/359; 451/456; 451/388; 451/450

(58) Field of Classification Search ..... 451/41, 451/354, 359, 456, 388, 450, 295
See application file for complete search history.

(56) References Cited

U.S. PATENT DOCUMENTS

| | | | | |
|---|---|---|---|---|
| 3,417,513 | A | 12/1968 | Zachek | |
| 4,614,063 | A * | 9/1986 | Crivaro et al. | 451/350 |
| 4,688,289 | A * | 8/1987 | Urakami | 15/98 |
| 4,809,383 | A * | 3/1989 | Urakami | 15/98 |
| 4,860,400 | A * | 8/1989 | Urakami | 15/98 |
| 4,969,914 | A * | 11/1990 | Ikegaya et al. | 451/439 |
| 5,042,208 | A * | 8/1991 | Richardson | 451/354 |
| 5,964,645 | A * | 10/1999 | Jemt | 451/41 |
| 6,092,517 | A * | 7/2000 | Schanel | 125/23.01 |
| 6,645,048 | B1 * | 11/2003 | Linderholm et al. | 451/28 |
| 7,115,018 | B1 * | 10/2006 | Syverson | 451/6 |
| 7,252,577 | B2 * | 8/2007 | Wood | 451/41 |
| 7,294,045 | B1 * | 11/2007 | Brown et al. | 451/44 |
| 7,316,604 | B1 * | 1/2008 | Burks | 451/354 |
| 7,387,564 | B2 * | 6/2008 | Jespersen | 451/354 |
| 7,459,811 | B2 * | 12/2008 | Hyun | 310/23 |

FOREIGN PATENT DOCUMENTS

| | | |
|---|---|---|
| CN | 2499170 Y | 7/2002 |
| FR | 2856621 | 12/2004 |
| WO | WO 2004/108351 A2 | 12/2004 |
| WO | WO 2007/093874 A1 | 8/2007 |

* cited by examiner

*Primary Examiner* — George Nguyen
(74) *Attorney, Agent, or Firm* — Dickstein Shapiro LLP

(57) ABSTRACT

A system, apparatus and method capable of grinding and polishing fabricated vertical surfaces of varying shapes and sizes without the use of hand tools. The system comprises a frame which can be affixed to the surface and which supports a grinding and polishing apparatus. The grinding and polishing apparatus uses air pressure to force a rotating grinding or polishing disc against the surface being worked on. The frame is designed so that the grinding and polishing apparatus can be moved (via, e.g., tracking) both vertically and horizontally to any desired point within the frame. The grinding and polishing apparatus optionally includes a water nozzle and vacuum system to spray and recapture water used to cool the surface being operated on.

16 Claims, 4 Drawing Sheets

STONE WALL GRINDING AND POLISHING SYSTEM

RELATED APPLICATIONS

This application claims priority to U.S. Provisional Application Ser. No. 61/144,766, filed Jan. 15, 2009.

FIELD OF THE INVENTION

Embodiments described herein relate to a grinding and polishing machine and, in particular, to a stone wall grinding and polishing system, apparatus and method.

BACKGROUND OF THE INVENTION

Historically, stone walls are ground only with hand tools, such as grinders and sand paper. This is due to the limitations of presently existing grinding machines, which are designed for use on stone floors. Such floor grinding machines use horizontally rotating grinding or polishing discs, which generally have rotating rounded diamond sectors, to level, smooth, or clean a stone surface. Gravity acting on the weight of the machine provides the pressure necessary to grind the floor with the grinding or polishing disc.

Some machines come equipped with a rubber sleeve to ensure that dust produced by the grinding process remains contained. Counter-rotating two disc models are also sometimes used to afford greater control to the operator. A floor grinding machine can also utilize water as it grinds the stone to avoid burning the stone. This water is recaptured as part of the grinding and polishing process, typically with a commercial water vacuum.

These floor grinding machines cannot be used to grind a vertical wall. That is, a grinding machine of this design cannot use its own weight to apply pressure to grind or polish a vertical wall, because of gravity and positioning. As such, walls must be ground with hand tools. In addition, the vertical nature of walls makes it difficult to recapture water if water is to be used to cool the surface during grinding or polishing; this means that water will run down the wall and pool where the wall and floor meet, which is undesirable. Accordingly, there is a need and desire for a system capable of grinding and polishing vertical surfaces without hand tools, which can apply proper pressure on the grinding or polishing disc so that surface is ground or polished. In addition, it is also desirable for such a system to have means to recapture any water used as coolant in the grinding or polishing process.

BRIEF SUMMARY OF THE INVENTION

The embodiments disclosed herein provide machines capable of grinding and polishing fabricated surfaces of varying shapes, sizes and slopes. Presently, there is no available machine or technology that provides the ability to grind or polish large-scale commercial walls without the use of hand tools. The embodiments described herein employ several distinct features which enable vertical or sloped grinding and polishing. First, a grinding apparatus is mounted to a frame which allows the apparatus to be moved in a predetermined path. Second, the frame itself is mounted to the surface to be polished by using vacuum cup suction. Third, an air compressor is used to apply pressure on the grinding or polishing disc, so that the surface is ground and polished. A water vacuum system may also be integrated into the machine to recapture water used for cooling the surface and removing debris.

BRIEF DESCRIPTION OF THE DRAWINGS

The technology is illustrated and described herein with reference to the various drawings, in which like reference numbers denote like method steps and/or system components, and in which.

DETAILED DESCRIPTION OF THE INVENTION

Figure 1A:
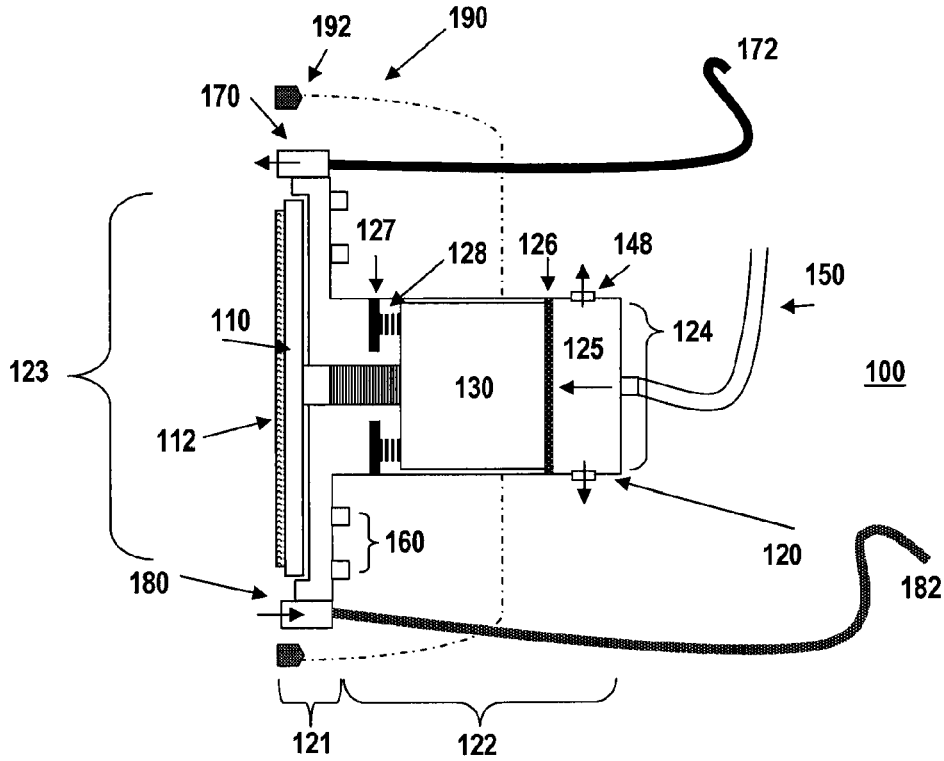
FIGS. 1A and 1B illustrate a grinding apparatus in accordance with an embodiment described herein.

Before describing the disclosed embodiments of the technology in detail, it is to be understood that the technology is not limited in its application to the details of the particular arrangement shown here since the technology is capable of other embodiments. Also, the terminology used herein is for the purpose of description and not of limitation.

Embodiments of the invention relate to a wall grinding and polishing system that employs compressed air to press a grinding or polishing apparatus against a vertical or sloped surface to grind or polish it. The compressed air forces a rotating grinding or polishing disc against the vertical or sloped surface, causing abrasion by the disc grains and grinding or polishing of the surface. This way, vertical or sloped surfaces can be ground or polished without the used of hand tools. The disclosed system can also integrate a water vacuum system to recapture water used to cool the surface. The wall grinding and polishing system is mounted to a frame, which is affixed to the vertical or sloped surface surface. The frame includes tracking so that the wall grinding and polishing system can be positioned at a desired point on the surface. Further, the frame can be flat or curved depending on the surface to be ground or polished. Vacuum cups can also be used to affix the frame to the surface to be worked on.

The disclosed wall grinding and polishing system is designed to confer high standard surface finish results on natural stones such as marble, granite, travertine and limestone, to name a few, which have been installed on a vertical surface. However, it is important to note that the disclosed wall grinding and polishing system is not limited to operating on natural stone surfaces and could also operate on wood, metal, or artificial stone (i.e. concrete) surfaces as well, among others.

There are a number of possible uses for the disclosed system. One such use relates to refreshing stones previously installed. As is the case with every natural product, environmental conditions, weather and the intervention of other natural and man-made elements over time result in the deterioration of the surface. The wall grinding and polishing system disclosed herein is able to process and refinish damaged surfaces on site by grinding down deteriorated portions. After this, the system can provide a desired refreshed finish in a range from gross honing up to glossy polish finish. It is important to note that no damage will result at edges in the event of open joints, because the force with which the polishing or grinding disc is pressed onto the surface being ground or polished can be varied by controlling the flow of compressed air. Also, the disclosed wall grinding and polishing system can be used to confer a desired finish in the event that, for instance, the finish is cannot be applied in the factory or when damage occurs to the surface during handling, packing, unpacking and/or installation.

Another use for the wall grinding and polishing system disclosed herein relates to the final finish of freshly installed stones, which can be processed at the installation site. The wall grinding and polishing system is adapted to create continuity of surface at joints, where there is often a lack of consistency in the geometry of close pieces due to limitations in present fabrication technology. Specifically, the equipment can correct for adjacent panels are partially concave or convex to each other.

The disclosed wall grinding and polishing system is operable to grind the ends of two inconsistent adjacent panels to create a flush surface where neither the eye nor the hand can appreciate any irregularity. In addition, provided proper joint filling materials with appropriate pigments are used in narrow joints near zero, and depending upon the type of stone, the wall grinding and polishing system is able to process ends of the panels and the filling materials to make joints virtually invisible to the eye and almost impossible to be felt by hand. Use in this manner allows construction of large surfaces that appear seamless. This is advantageous because smaller panel sizing can be used, at decreased cost, to achieve the same visual result as if larger panels were used.

Figure 1B:
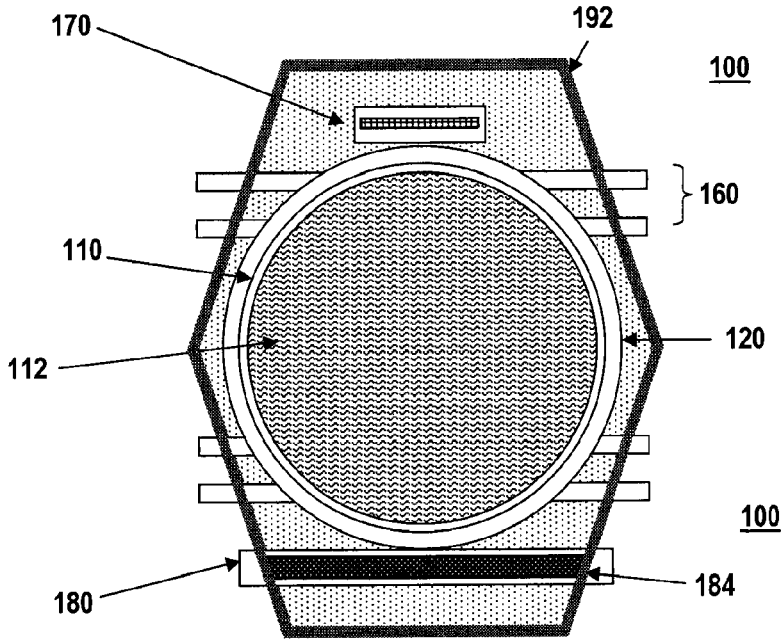

FIGS. 1A and 1B illustrate a grinding or polishing apparatus 100 designed for use in the disclosed wall grinding and polishing system. A grinding or polishing disc 110 with an abrasive surface 112 is attached to a motor assembly 130. The grinding or polishing disc 110 can be removed or replaced by other discs 110 with different surfaces 112. Alternatively, the surfaces 112 themselves may be interchangeable.

The motor 130 is mounted inside a hollow body 120 and set against stands 127 in a forward portion of the hollow body 120 by springs 128 or other counterforce mechanism. The hollow body 120 comprises two cylinders 121, 122 joined to accommodate grinding or polishing disc 110 at an open end 125, and motor assembly 130 where the cylinders 121, 122 are joined. An air stop 128 attached to the rear of the motor assembly 130 and creates an air chamber 125 inside a closed rear end 124 of the body 120, which during operation is filled with compressed air from hose 150. The air pressure in chamber 125 causes the air stop 126 and motor assembly 130 to be pushed against the springs 128, compressing them against the stands 127. As the motor assembly 130 advances, the grinding and polishing disc is pushed against the surface to be worked on. Pressure inside the air chamber can be regulated by one or more optional vents 148.

In one embodiment, two sets of mounting rails 160 are used to attach the apparatus 100 to a frame (such as that illustrated in FIG. 2). The apparatus 100 can also include a water nozzle 170 (fed by hose 172) for spraying the surface being ground or polished with water (or some other liquid) to cool the surface and prevent burning. A water vacuum system 180 can be employed to recapture water and dust (via hose 182) as it runs down the surface being ground or polished. In the FIG. 1B embodiment, the vacuum nozzle 184 is at least as long as a diameter of the grinding and polishing disc 110. Optionally, a dust cover 190 with rubber (or similar material) seal 192 can be employed to cover the apparatus 100 and prevent dust from escaping. In one embodiment, a common compressor is used to provide compressed air via hose 150 and vacuum via hose 182.

Figure 2A:
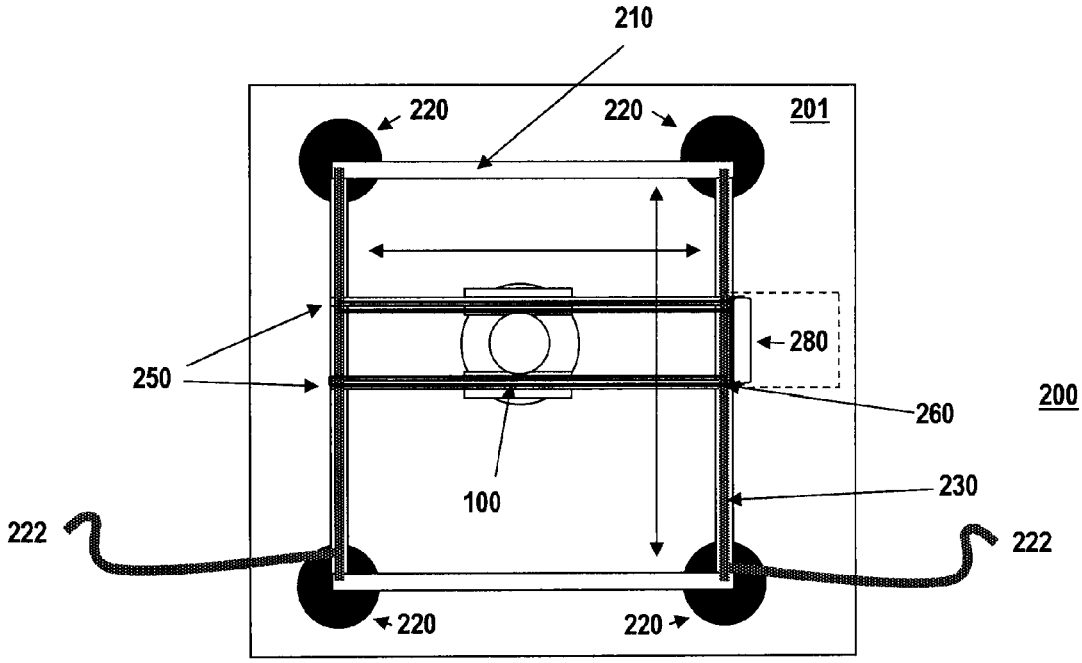
FIGS. 2A and 2B illustrate a flat frame and a grinding apparatus in accordance with an embodiment described herein.
Figure 2B:
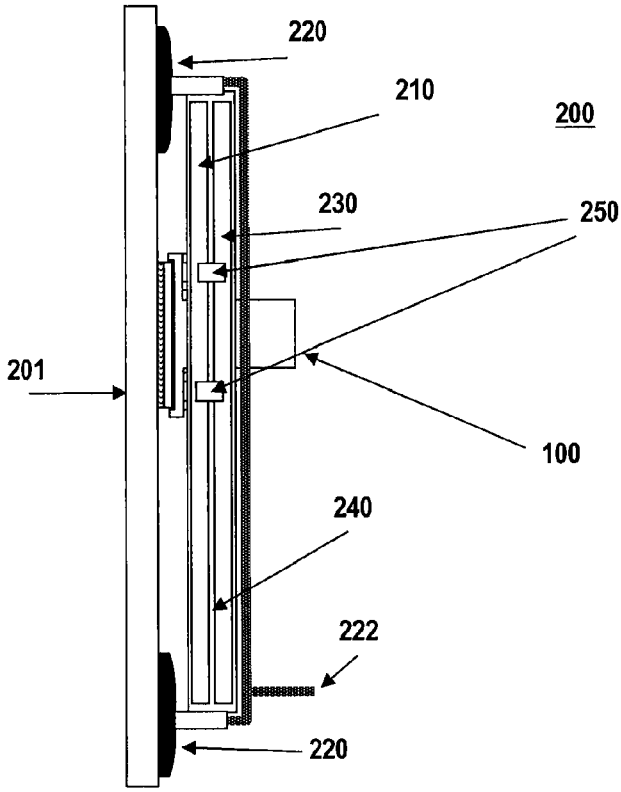

FIGS. 2A and 2B illustrates a flat frame wall grinding and polishing system 200 using the grinding or polishing apparatus 100 shown in FIGS. 1A and 1B for grinding or polishing surface 201. The grinding or polishing apparatus 100 is mounted on a rectangular or square-shaped frame 210, which is affixed to the surface 201 by a number of vacuum cups 220 fed by hoses 222. In one embodiment (pictured), the cups 220 are located at the corners of the frame 210. However, it can be appreciated that the cups could be mounted anywhere on the frame 210 in locations that do not interfere with the grinding or polishing operation.

Frame 210 includes vertical rails 230 and frame tracks 240 on its outer vertical edges. Horizontal rails 260 are mounted in the vertical frame tracks 240. The braces 260 themselves have horizontal frame tracks 250 to which the mounting rails 160 on the grinding or polishing apparatus 100 can be affixed. Accordingly, the grinding or polishing apparatus 100 can be moved both vertically and horizontally within frame 210, as illustrated.

An optional motor assembly 280 and belts (not pictured) can be attached to automatically move the grinding or polishing apparatus 100 along tracks 240 and 250 to a desired position on the surface 201. Motor 280 could be computer controlled, so that grinding and polishing programs could be executed automatically. A camera (not pictured) could also be mounted on the grinding or polishing apparatus 100 to allow a control computer to automatically evaluate a level of grinding or polishing needed to achieve a desired finish on surface 201.

Figure 3:
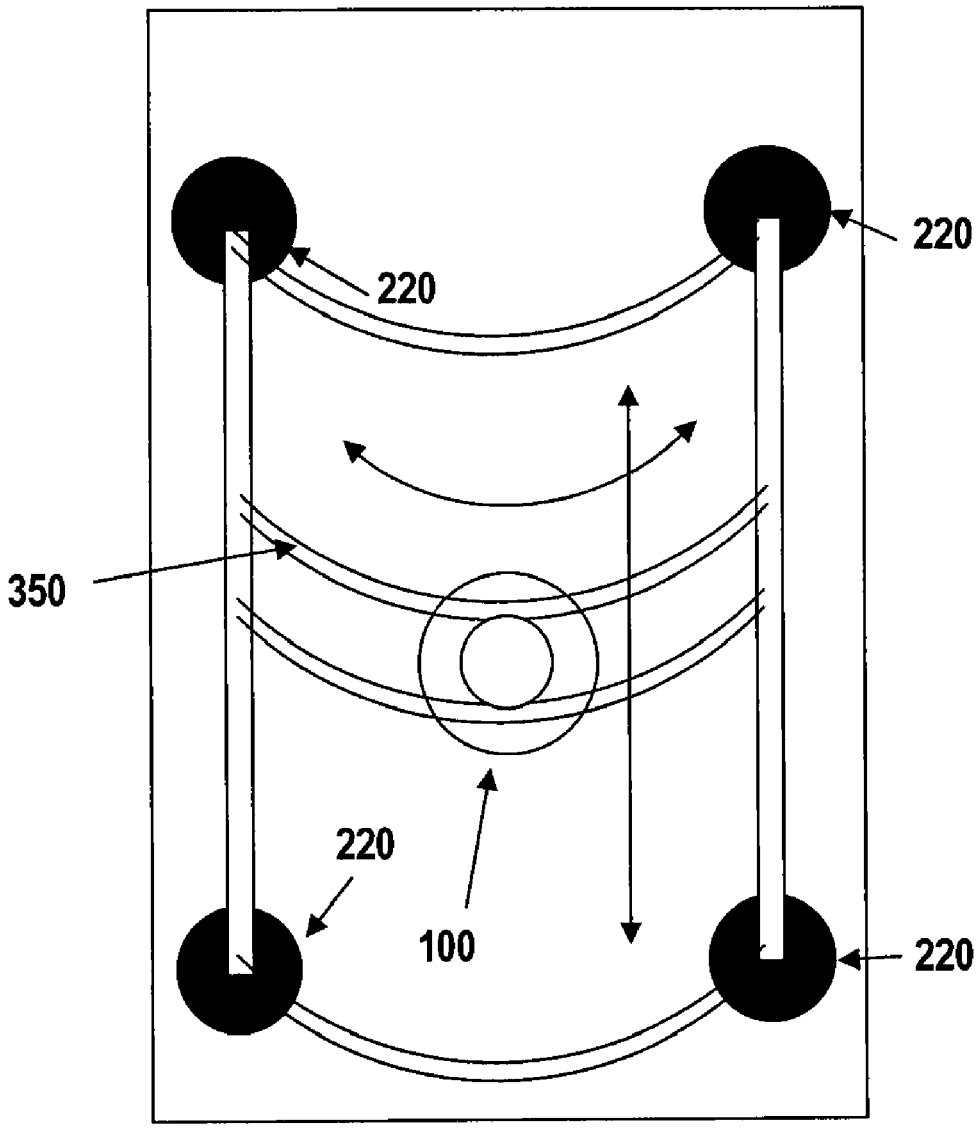
FIG. 3 illustrates a curved frame and a grinding apparatus in accordance with an embodiment described herein.

FIG. 3 shows another embodiment with a frame 310 having curved horizontal rails 350. This particular embodiment is useful for grinding and polishing curved surfaces, i.e., columns. It can be appreciated that frames 210/310 can be formed in any suitable shape to accommodate the curvature or size of the surface to be polished.

Figure 4:
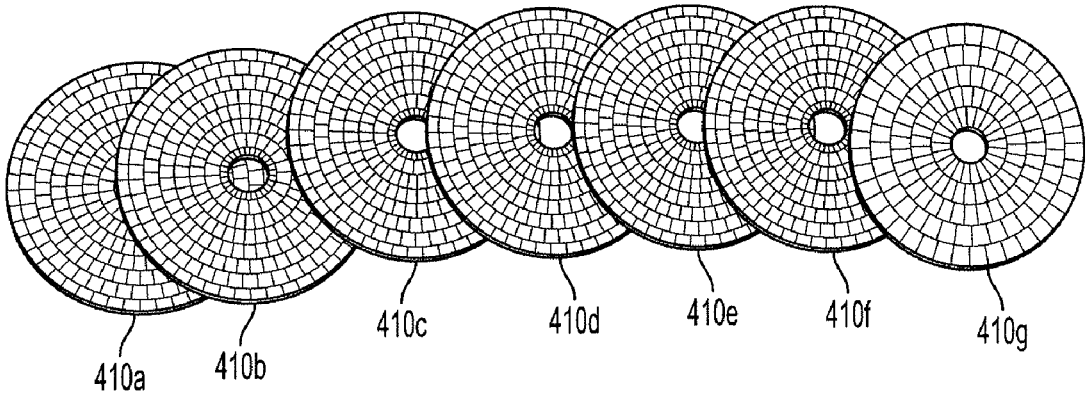
FIG. 4 illustrates exemple grain patterns for grinding or polishing discs used in accordance with an embodiment described herein.

FIG. 4 illustrates examples of grain patterns 410*a-g* used with the grinding/polishing discs that may be used by the disclosed system. As can be seen, many different grains (e.g., 40, 60, 80, 120, 200, 300, 400, 600, 800, 1500, or 3000 LUX) may be used with the same disc. The abrasive surfaces are used to grind and polish the walls.

In operation, frame 210/310 is attached to a surface 201 or another portion of a building around the surface to be polished. The grinding or polishing apparatus 100 is attached to the frame 210. The appropriate grain pattern 410*a-g* is applied to the grinding or polishing disc 110. A compressor is activated to apply air pressure (via hose 150) to and force the grinding or polishing disc 110 (and the abrasive surface 112) to contact the surface 201. Counterforce is applied by the vacuum cups affixing the frame 210/310 to the surface 201. Water is applied to the stone via nozzle 170 and a vacuum system 180 (optionally provided by the same compressor) recaptures the water during the grinding or polishing. Accordingly, grinding and polishing of a vertical or sloped stone wall, which is already applied to a structure, may be achieved without the use of hand tools or specialized water recapture equipment.

Although the embodiments and applications as described above relate to grinding or polishing a vertical or sloped surface, it should be understood that they may also be embodied in and applied with any grinding and polishing system.

The above description and drawings should only be considered illustrative of example embodiments that achieve the features and advantages described herein. Modification and substitutions to specific process conditions and structures can be made. Accordingly, the claimed invention is not to be considered as being limited by the foregoing description and drawings, but is only by the scope of the appended claims.

What is claimed is:

1. An apparatus for grinding or polishing a surface, comprising:

an open-ended hollow body;

a motor assembly in the hollow body set against at least one stand in a forward portion of the body by a counterforce mechanism;

a grinding or polishing disc attached to a forward end of the motor assembly and set in the open end of the hollow body, the grinding or polishing disc being adapted to be rotated by the motor assembly to grind or polish the surface;

an air stop attached to the rear of the motor to form an air chamber in the rear of the hollow body; and a compressed air hose attached to the rear of the hollow body adapted to increase air pressure in the air chamber and thereby force the motor assembly and grinding or polishing disc forward against the surface to be polished.

2. The apparatus of claim 1, wherein the grinding or polishing disc has a removable abrasive surface portion.

3. The apparatus of claim 1, further including a nozzle mounted to the body and being adapted to spray a cooling liquid at the surface to be polished.

4. The apparatus of claim 3, wherein the liquid is water.

5. The apparatus of claim 3, further including a vacuum system attached to the body.

6. The apparatus of claim 5, wherein a nozzle of the vacuum system is at least as wide as a diameter of the grinding or polishing disc.

7. The apparatus of claim 1, further including a plurality of vents to regulate the pressure in the air chamber.

8. The apparatus of claim 1, further including a dust cover situated over at least the open end of the hollow body and grinding or polishing disc.

9. The apparatus of claim 1, wherein the counterforce means are springs.

10. A system for grinding or polishing a vertical or sloped surface, the system comprising:

a frame adapted to be affixed to the vertical or sloped surface, the frame comprising at least two tracked vertically oriented rails, and a horizontally oriented rail mounted in the vertically oriented tracks; and a grinding or polishing device mounted to the horizontally oriented rail, the device comprising a rotatable grinding and polishing disc, wherein compressed air is used to press the grinding and polishing disc against the vertical or sloped surface, said grinding or polishing device comprising:

a motor assembly in a hollow body of said device and being set against at least one stand in a forward portion of the body by a counterforce mechanism, the grinding or polishing disc being attached to a forward end of the motor assembly and set in an open end of the hollow body, the disc being adapted to be rotated by the motor assembly to grind or polish the surface, and an air stop attached to a rear of the motor to form an air chamber in the rear of the hollow body.

11. The system of claim 10, wherein the frame is affixed to the vertical surface by at least one vacuum cup.

12. The system of claim 10, further including at least four vacuum cups located at corners of the frame.

13. The system of claim 10, wherein the horizontally oriented rails are curved.

14. The system of claim 10, wherein the horizontally oriented rails are straight.

15. The system of claim 10, wherein the surface is a substantially vertical plane.

16. The system of claim 10, further including a computer controllable motor assembly mounted to the horizontally oriented rail and adapted to move the grinding or polishing device vertically or horizontally to a desired point within the frame.

* * * * *